US007419317B2

(12) United States Patent
Akaiwa

(10) Patent No.: US 7,419,317 B2
(45) Date of Patent: Sep. 2, 2008

(54) PRINT-AND-EMBOSSING COMPOSITE APPARATUS FOR SUPERPOSING INK AND EMBOSSING CHARACTERS ON AN OBJECT

(75) Inventor: Masao Akaiwa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 26 days.

(21) Appl. No.: 11/107,065

(22) Filed: Apr. 15, 2005

(65) Prior Publication Data

US 2005/0281599 A1 Dec. 22, 2005

(30) Foreign Application Priority Data

Jun. 17, 2004 (JP) ..... 2004-179690

(51) Int. Cl.
*B41J 3/32* (2006.01)

(52) U.S. Cl. ..... 400/109.1; 400/129; 400/130; 400/134.4; 400/134.5; 400/483; 101/4; 101/32

(58) Field of Classification Search ..... 400/109.1, 400/122, 82, 188, 118, 109, 134.4, 134.5, 400/483; 101/18, 4, 32, 129
See application file for complete search history.

(56) References Cited

U.S. PATENT DOCUMENTS 3,065,299 A * 11/1962 Frey ..... 178/92
3,880,269 A * 4/1975 Carbonneau ..... 400/109.1
3,903,617 A * 9/1975 Evans ..... 434/171
4,175,851 A * 11/1979 Kitamura et al. ..... 347/129
4,404,764 A * 9/1983 Wills et al. ..... 40/124.11
5,193,921 A * 3/1993 Tsukuda et al. ..... 400/109.1
5,222,819 A * 6/1993 Tsukuda et al. ..... 400/109.1
5,374,132 A * 12/1994 Kimura ..... 400/586
5,529,414 A * 6/1996 Katano et al. ..... 400/636.2
5,779,482 A * 7/1998 Fukumoto ..... 434/113
5,853,256 A * 12/1998 Kim ..... 400/624
6,491,215 B1 * 12/2002 Irwin et al. ..... 235/375
6,539,854 B2 * 4/2003 Maeda et al. ..... 101/118
6,816,268 B1 * 11/2004 Suzuki ..... 358/1.11
2002/0015167 A1 * 2/2002 Watanabe et al. ..... 358/1.11
2003/0048326 A1 * 3/2003 Yamasaki et al. ..... 347/41
2005/0227207 A1 * 10/2005 McAdams et al. ..... 434/114

FOREIGN PATENT DOCUMENTS

JP 10-275206 10/1998
JP 2001-088358 * 3/2001

* cited by examiner

*Primary Examiner*—Leslie J. Evanisko
*Assistant Examiner*—Matthew G Marini
(74) *Attorney, Agent, or Firm*—Hogan & Hartson LLP

(57) ABSTRACT

A print processing method of a printing-and-embossing composite apparatus in which ink-characters printing and braille embossing are performed on the same object based on inputted character information, wherein, in cases where the ink-characters printing and the braille embossing are performed on the same object in a superposed state, and a character size for use in the ink-characters printing is set equal to or less than a given size, the ink-characters printing is barred.

3 Claims, 14 Drawing Sheets

FIG. 8

CHARACTER P : AAA
CHARACTER S : AAA
CHARACTER M : AAA

TAPE(12MM WIDTH, TWO-LINE INPUTTING)

| No | INPUT SIZES | PRINTING POSSIBLE? | SIZES AFTER CHANGE |
|---|---|---|---|
| 1. | M+M | ○ | M+M |
| 2. | S+S | ○ | S+S |
| 3. | P+M | × | S+M |
| 4. | S+M | ○ | S+M |
| 5. | S+M | ○ | S+M |
| 6. | M+S | ○ | M+S |
| 7. | M+S | ○ | M+S |
| 8. | M+P | × | M+S |

CHARACTER P : AAA
CHARACTER S : AAA
CHARACTER M : AAA

FIG. 9A

TAPE (12 MM WIDTH, THREE-LINE INPUTTING)

| No | INPUT SIZES | PRINTING POSSIBLE? | SIZES AFTER CHANGE |
|---|---|---|---|
| 1. | S+S+S | ○ | S+S+S |
| 2. | M+P+P | × | S+S+S |
| 3. | S+P+P | × | S+S+S |
| 4. | M+S+P | × | S+S+S |
| 5. | S+S+P | × | S+S+S |
| 6. | S+M+P | × | S+S+S |
| 7. | P+M+P | × | S+S+S |
| 8. | P+S+P | × | S+S+S |
| 9. | P+M+S | × | S+S+S |
| 10. | P+S+S | × | S+S+S |
| 11. | P+S+M | × | S+S+S |
| 12. | P+P+S | × | S+S+S |
| 13. | P+P+M | × | S+S+S |
| 14. | S+P+M | × | S+S+S |
| 15. | S+P+S | × | S+S+S |
| 16. | M+P+S | × | S+S+S |

FIG. 9B

TAPE (12 MM WIDTH, FOUR-LINE INPUTTING)

| No | INPUT SIZES | PRINTING POSSIBLE? | SIZES AFTER CHANGE (THREE LINES) |
|---|---|---|---|
| 1. | P+P+P+P | × | S+S+S |

TAPE(12 MM WIDTH, THREE-LINE INPUTTING)

CHARACTER STRING FOR INPUTTING
1ST LINE : OOITOSEN(CHARACTER S)
2ND LINE : ROKUBANSEN(CHARACTER P)
3RD LINE : ORIGUCHI(CHARACTER M)

PRESS MODE SELECTING KEY

BRAILLE PRINTING
INK CHARACTERS ONLY
INK CHARACTERS/BRAILLE
BRAILLE ONLY
T10

PRESS PRINTING/EMBOSSING KEY

FIG. 12A

PRINTING IS IMPOSSIBLE
CHANGE SIZE?
T11

PRESS PRINTING/EMBOSSING KEY OR SELECTING KEY

DESIGNATE LINE FOR BRAILLE EMBOSSING
1 OOITOSEN
2 ROKUBANSEN
T12

「1」INPUT (Note: Alphabets are transliteration from kanji characters; braille corresponds to pronunciation of kanji.)

FIG. 12B

〈IMAGE OF LABEL SUBJECTED TO PRINTING AND EMBOSSING〉

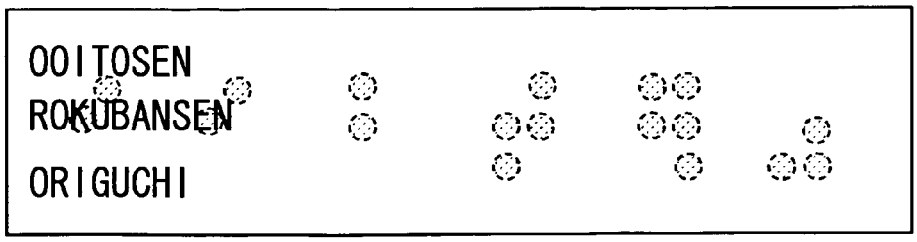

FIG. 12C

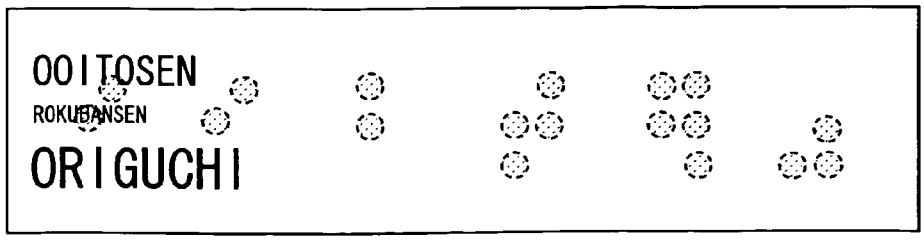

TAPE (12 MM WIDTH, FOUR-LINE INPUTTING)

CHARACTER STRING FOR INPUTTING
1ST LINE : OOITOSEN (CHARACTER P)
2ND LINE : ROKUBANSEN (CHARACTER P)
3RD LINE : ORIGUCHI (CHARACTER P)
4TH LINE : KAIDANTESURI (CHARACTER P)

PRESS MODE SELECTING KEY

BRAILLE PRINTING
INK CHARACTERS ONLY
INK CHARACTERS/BRAILLE
BRAILLE ONLY
T20

PRESS PRINTING/EMBOSSING KEY

PRINTING IS IMPOSSIBLE
DESIGNATE LINE FOR DELETION
T21

「4」 INPUT

DESIGNATE LINE FOR BRAILLE EMBOSSING
1 OOITOSEN
2 ROKUBANSEN
T22

(Note: Alphabets are transliteration from kanji characters; braille corresponds to pronunciation of kanji.)

「1」 INPUT

FIG. 13A

FIG. 13B

〈IMAGE OF LABEL SUBJECTED TO PRINTING AND EMBOSSING〉

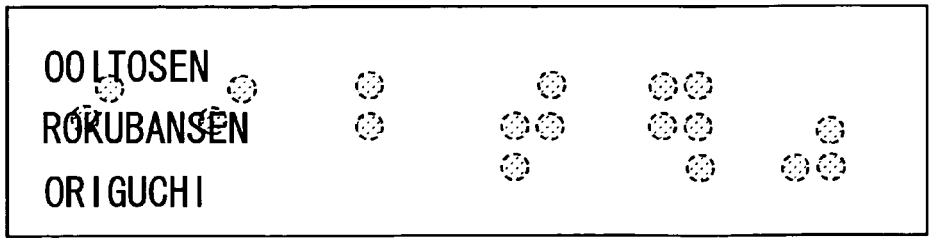

FIG. 13C

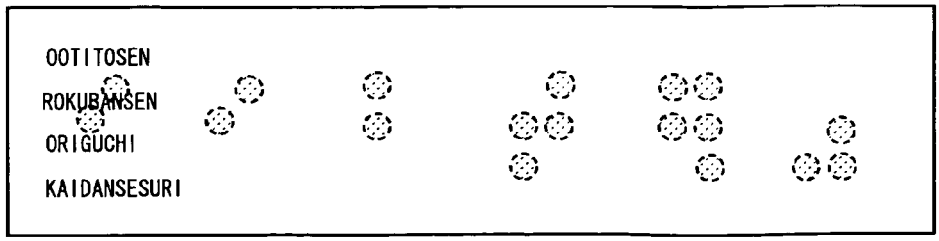

PRINT-AND-EMBOSSING COMPOSITE APPARATUS FOR SUPERPOSING INK AND EMBOSSING CHARACTERS ON AN OBJECT

BACKGROUND OF THE INVENTION

1. Field of the Invention

The present invention relates to a print processing method of a printing-and-embossing composite apparatus capable of printing and embossing ink characters and braille on the same printing face in such a manner that they are superposed one upon the other, a printing-and-embossing composite apparatus, and a program.

2. Description of the Related Art

Conventionally, there is known a printing-and-embossing composite apparatus in which are superposed on the front face of a braille label an ink-characters printing region for printing ink characters (i.e., normal printing characters as opposed to braille) recognizable by visually-normal people and a braille embossing region for embossing braille, to thereby print and emboss in such a manner that they are superposed one upon the other. This allows both visually-normal people and visually-impaired people to identify printing contents and save a printing region of a braille label.

However, when ink characters are printed on a print medium with a particularly small width over a plurality of lines, or a character size is set intentionally smaller, resulting ink characters can almost be the same in size as the embossing convex portion. Accordingly, when ink characters and braille are printed and embossed in a superposed state with the above-described printing-and-embossing apparatus, the ink characters and the embossing convex portion tend to be superposed, which can deform printed ink-characters because of a rising embossing convex portion, and causes severe illegibility.

SUMMARY OF THE INVENTION

In view of the above, the present invention has an advantage of providing a print processing method of a printing-and-embossing composite apparatus, a printing-and-embossing composite apparatus, and a program, which can prevent illegibility of printed ink-characters when ink characters and braille are printed and embossed in a superposed state.

According to one aspect of the present invention, there is provided a print processing method of a printing-and-embossing composite apparatus in which ink-characters printing and braille embossing are performed on the same object based on inputted character information, wherein, in cases where the ink-characters printing and the braille embossing are performed on the same object in a superposed state, and a character size for use in the ink-characters printing is set equal to or less than a given size, the ink-characters printing is barred.

Preferably, the given size of a character is substantially the same as that of the plane face of an embossing convex portion formed by the braille embossing.

According to another aspect of the present invention, there is provided a printing-and-embossing composite apparatus comprising: a printing-and-embossing processing means capable of performing on the same object a superposing process for ink-characters printing and braille embossing, based on inputted character information; a size setting means for setting a character size for use in the ink-characters printing based on the inputted character information; a determining means for determining whether or not the character size set by the size setting means is set equal to or less than a given size;

an ink-characters-printing barring means for barring the ink-characters printing caused by the printing-and-embossing processing means, in cases where the superposing process is performed, and the determining means determines that the character size is set equal to or less than the given size.

Preferably, the given size of a character is substantially the same as that of the plane face of an embossing convex portion formed by the braille embossing.

With these configurations, when the ink-characters printing and the braille embossing are performed in a superposed state, ink-characters printing for a character whose size is set to the size substantially the same as that of the plane face of the embossing convex portion formed by the braille embossing is barred to reduce the possibility of causing printed ink-characters to be deformed because of a rising embossing convex portion, to prevent the printed ink-characters from being illegible. Although it depends on the thickness of the ink characters involved, the phrase "substantially the same" used herein refers to an identify level likely to cause the ink characters involved to be unrecognizable or misidentified when the ink characters and the embossing convex portion overlap each other.

Preferably, the printing-and-embossing composite apparatus further comprises a size changing means for changing the set character size to one which exceeds the given size when the ink-characters printing is barred by the ink-characters-printing barring means.

With this configuration, when inputted character information has a character whose size is set equal to or less than the a given size which is substantially the same as that of the plane face of the embossing convex portion formed by the braille embossing, and the ink-characters printing is barred, the character size set equal to or less than the given size is changed to a size which exceeds the given size. Accordingly, it is made possible to eliminate the labor of editing the inputted character information and setting the character size again. In other words, the operating efficiency of the user can be enhanced.

Preferably, in cases where the character information is inputted over a plurality of lines and the character size is set for each line to fit into a specific width range of the object, but the character information fails to fit into the width range as a result of a change in the character size, the size changing means changes the character sizes of the lines other than the one line for which the character size has been set equal to or less than the given size, to a character size equal to or less than the original size thereof.

With this configuration, in a case where the character information is inputted over the plurality of lines, but fails to fit into the width range as a result of a change in the character size, the character sizes of the lines other than the one for which the character size has been set equal to or less than the given size are reduced. Accordingly, the size change process makes it possible to eliminate the possibility of causing the printed ink-characters to protrude partially from the width of the object involved and be broken.

Preferably, in cases where the character information is inputted over the plurality of lines and the character size is set for each line to fit into the specific width range of the object, but the character information fails to fit into the width range as a result of a change in the character size, the size changing means deletes the character string of the designated specific line.

With this configuration, when the character information whose size is equal to or less than a given size is inputted over the plurality of lines, the character string of the designated specific line of the plurality of lines is deleted as a result of a change in the character size set equal to or less than the given size. Accordingly, the size change process makes it possible to eliminate the possibility of causing the printed ink-characters to protrude partially from the width of the object involved and be broken.

Preferably, the printing-and-embossing composite apparatus further comprises an embossing-character designating means for designating the inputted character information in whole or in part as a braille embossing object.

With these configurations, since one of the inputted character information can be designated to be embossed in braille, the character information for the ink-characters printing and the braille embossing can be inputted in a series of operations. In addition, the character information to be embossed in braille can be easily and arbitrarily designated with part of the character information being designated. Since braille is generally composed by keywords, the braille embossing object can be efficiently designated.

Preferably, the embossing-character designating means can be arranged such that it designates the braille embossing object for each line.

With these configurations, since the character information to be embossed in braille can be designated for each line, the braille embossing object can be designated with easier operation.

According to still another aspect of the present invention, there is provided a printing-and-embossing composite apparatus comprising: a printing-and-embossing processing means capable of performing on the same object a superposing process for ink-characters printing and braille embossing, based on inputted character information; a size setting means for setting a character size for use in the ink-characters printing based on the inputted character information; and a given-size-setting barring means for barring the setting of a given size by the size setting means, for performing the superposing process.

Preferably, the given size is substantially the same as that of the plane face of an embossing convex portion formed by the braille embossing.

With these configurations, when the ink-characters printing and the braille embossing are performed in a superposed state, the setting of the size substantially the same as that of the plane face of the embossing convex portion formed by the braille embossing is barred. Accordingly, there occurs no possibility of causing the size of the inputted character information to be set equal to or less than a given size. In other words, even when ink-characters printing and braille embossing are performed in a superposed state, it is possible to reduce the possibility of causing the whole printed ink-characters to be deformed because of a rising embossing convex portion. Accordingly, illegibility of the printed ink-characters can be prevented. Moreover, it is made possible to eliminate the labor of changing the character size and deleting input character information with the printing-and-embossing composite apparatus, thereby shortening the process time for editing.

According to yet another aspect of the present invention, there is provided a program which causes a computer to perform each of the means of the printing-and-embossing composite apparatus as described above.

With this configuration, a program preventing illegibility of printed ink-characters can be provided.

BRIEF DESCRIPTION OF THE DRAWINGS

The above and other objects and the attendant features of this invention will become readily apparent by reference to the following detailed description when considered in conjunction with the accompanying drawings wherein:

FIG. 8 is a diagram showing setting size patterns (for two-line inputting) provided in the printing-and-embossing composite apparatus;

FIGS. 9A and 9B are diagrams showing setting size patterns (for three-to-four-line inputting) provided in the printing-and-embossing composite apparatus;

FIG. 12A is a screen transition showing a flow of printing and embossing in the printing-and-embossing composite apparatus, FIG. 12B is a label subjected to the flow of ink-characters printing and braille embossing, and FIG. 12C is a label formed of ink-characters printing and braille embossing in character sizes set at the original inputting and without being subjected to size determination and size change processes of the present invention;

FIG. 13A is a screen transition showing a flow of printing and embossing in the printing-and-embossing composite apparatus, and FIG. 13B is a label subjected to the flow of ink-characters printing and braille embossing, and FIG. 13C is a label formed of ink-characters printing and braille embossing in character sizes set at the original inputting and without being subjected to size determination and size change processes of the present invention.

DETAILED DESCRIPTION OF THE PREFERRED EMBODIMENTS

Hereinafter, a description will be made about an embodiment of a printing method of a printing-and-embossing composite apparatus, a printing-and-embossing composite apparatus, and a program of the present invention, with reference to the accompanying drawings.

First, the printing-and-embossing composite apparatus 1 of the present invention will be described with reference to FIGS. 1 to 6. The printing-and-embossing composite apparatus 1 is composed of an ink-characters printing section 10 for ink-characters printing and of a braille embossing section 30 for braille embossing, which respectively are arranged at front and rear parts of the apparatus. According to this configuration, a tape T printed by the ink-characters printing section 10 is ejected, and the user then inserts the same into an embossing-tape inserting part 33 of the braille embossing section 30 for braille embossing.

Figure 1:
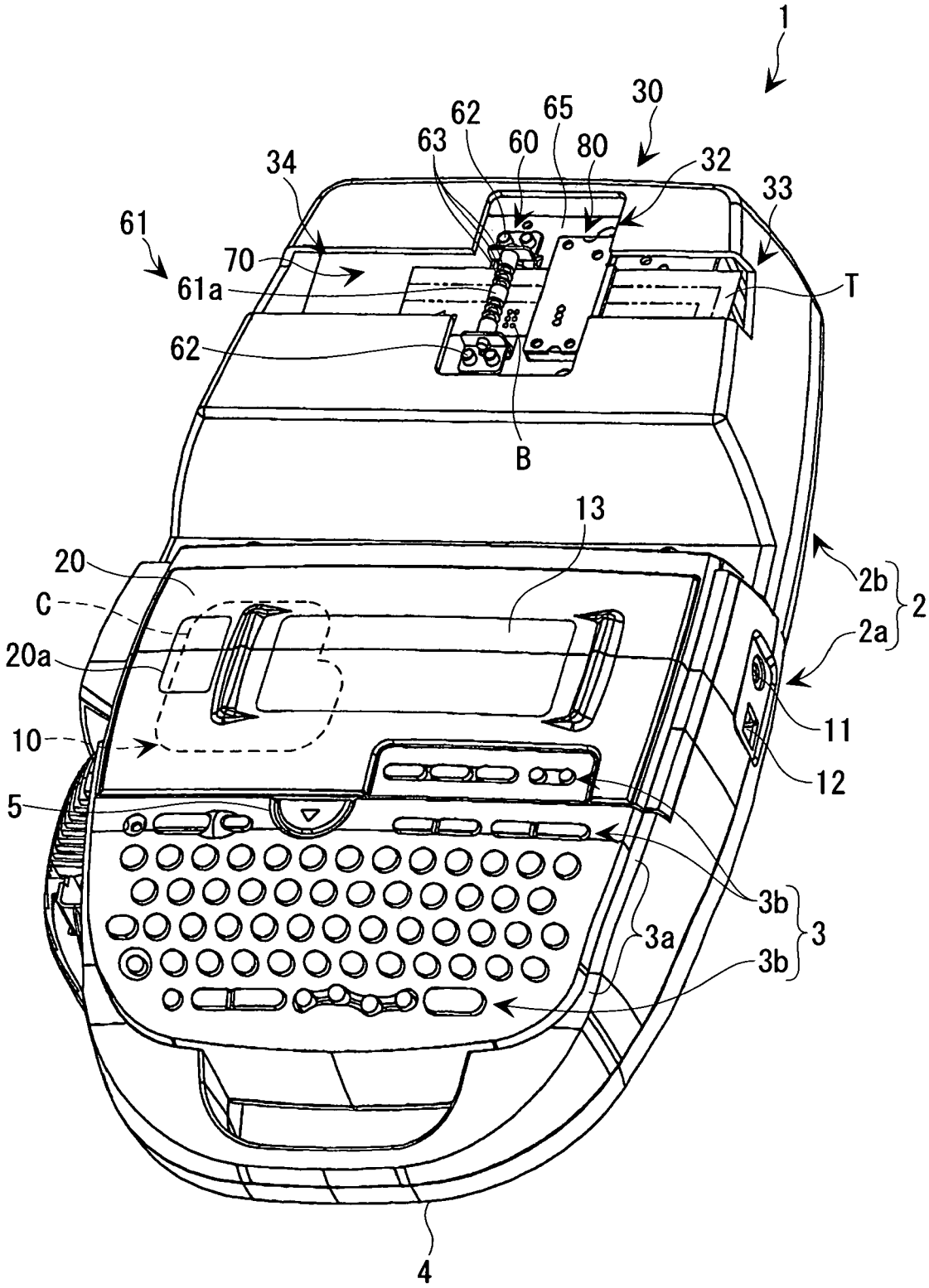
FIG. 1 is an external perspective view of a printing-and-embossing composite apparatus according to an embodiment of the present invention with its cover closed.
Figure 2:
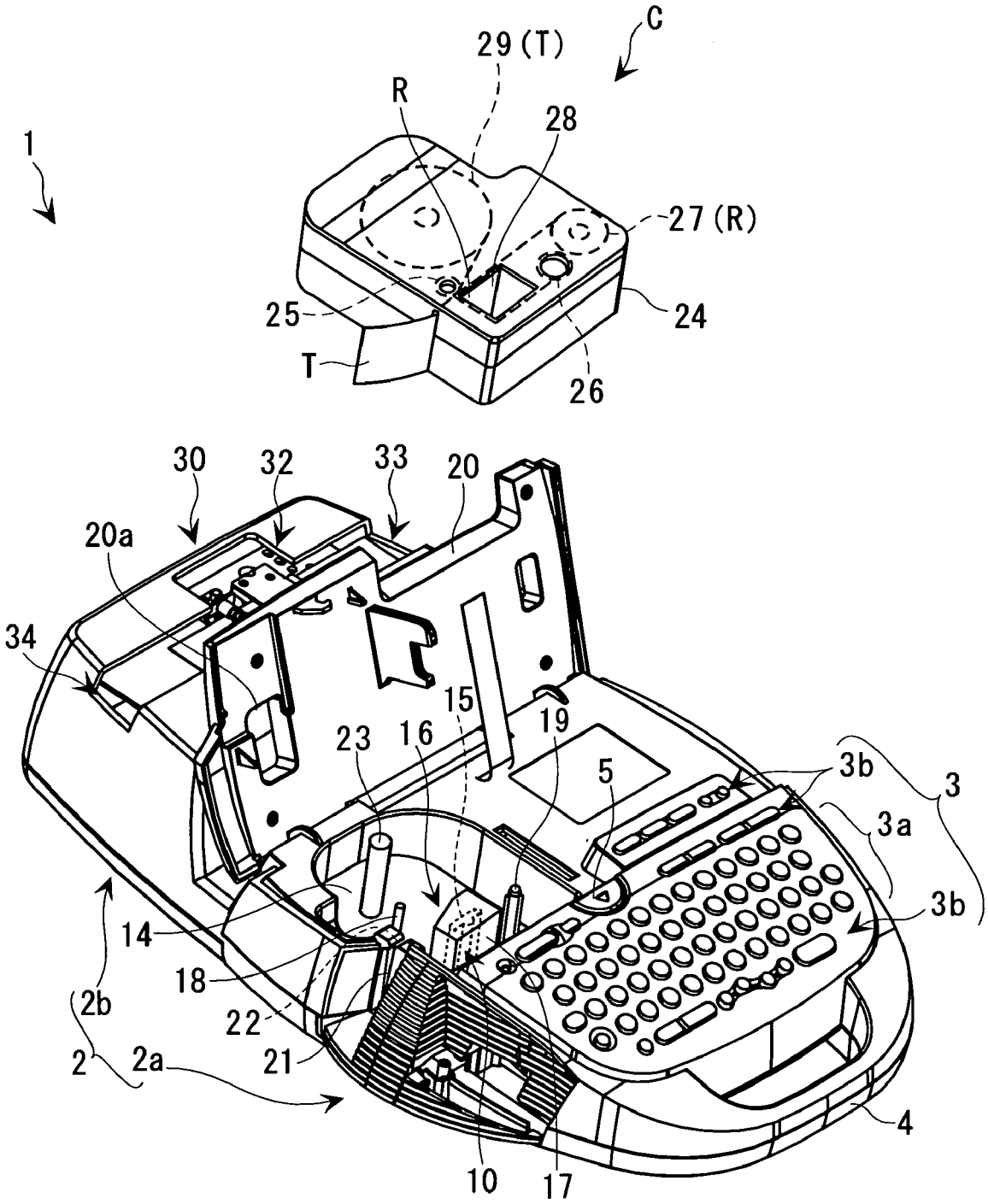
FIG. 2 is an external perspective view of a printing-and-embossing composite apparatus according to an embodiment of the present invention with its cover open.

FIGS. 1 and 2 are external perspective views of the printing-and-embossing composite apparatus 1 with its cover closed and open, respectively. As shown in the figures, the printing-and-embossing composite apparatus 1 has an outer shape formed by an apparatus casing 2 having a carrier handle 4 at a front end thereof, and the casing 2 is integrally formed by a front casing 2*a* and a rear casing 2*b*. The front casing 2*a* has an ink-characters printing section 10 where ink characters are printed on the tape T reeled out from a tape cartridge C. The rear casing 2*b* has a braille embossing section 30 where braille is embossed when the user manually feeds the tape T ejected from the ink-characters printing section 10 thereinto (i.e., the user holds the tape T with the tips of his/her fingers and then guides the same into the braille embossing section 30).

The front casing 2*a* has a front top face where a keyboard 3 provided with various input keys is arranged, and has a rear top face to which an opening/closing cover 20 is attached. The opening/closing cover 20 has a central portion arranged by a rectangular display 13. Inside the opening/closing cover 20, there is provided a recessed cartridge mounting section 14 (ink-characters printing section 10) for mounting the tape cartridge C accommodating the tape T and an ink ribbon R on the left side thereof. The tape cartridge C is detachably mounted in the cartridge mounting section 14 in a state where the opening/closing cover 20 is opened by pressing a cover opening button 5. In addition, the opening/closing cover 20 has formed on the left side thereof an discrimination window 20*a* for discriminating the mounting/non-mounting of the tape cartridge C in its closed state.

In the right side of the front casing 2*a*, there are formed a power source supplying port 11 for supplying power source, and a connecting port 12 (interface) for connecting with external devices (not shown) such as a personal computer. When the external devices are connected to the connecting port 12, it is made possible to print ink characters or emboss braille based on character information generated by the external devices.

Further, in the left side of the front casing 2*a*, there is formed a printing-tape ejecting port 21 for communicating the cartridge mounting section 14 with the outside of the apparatus. At the printing-tape ejecting port 21, there is arranged a scissors-like tape cutter 22, which is driven by a motor (cutter motor 131, see FIG. 6). The tape T printed with ink characters is cut off by the tape cutter 22 and ejected from the printing-tape ejecting port 21.

The keyboard 3 is used for inputting into after-mentioned controlling section 200 various directions and data, and has arranged therein a characters key group 3*a* including an alphabet key group, a symbol key group, a numeric key group, and a kana-characters key group, and a functions key group 3*b* to direct various operations. The functions key group 3*b* includes: a selecting key for data confirmation and line feed when characters are inputted and for selecting and directing various modes on a selection screen; a canceling key for canceling various inputs; a shift key for changing functions of the keys; four cursor keys for moving a cursor and a display range of a display screen 13; a printing/embossing key for causing printing/embossing to operate; a file form key for operating files and selecting print formats; a mode selecting key for setting after-mentioned printing modes, etc.

The display 13 is rectangular with sides of approx. 12 cm in width (in X direction) and 5 cm in length (in Y direction) where display image data of 192 dots×80 dots is displayed. The user views the display while he/she inputs character information through the keyboard 3 to form/edit ink-characters data for ink-characters printing and braille data for braille embossing. In addition, various error messages or command contents are displayed on the display to notify the user of the fact.

The cartridge mounting section 14 is provided with: a head unit 16 with a head cover 17 including a printing head 15 composed of a thermal head; a platen driving shaft 18 arranged at a position opposed to the printing head 15; a reel driving shaft 19 for reeling up the ink ribbon R; and a positioning projection 23 for a tape reel 29. Note that the reel driving shaft and the positioning projection will be describe below. In addition, at the bottom of the cartridge mounting section 14, there are embedded a printing feeding motor 121 (see FIG. 6) for causing the platen driving shaft 18 and the reel driving shaft 19 to rotate, and a torque transmission mechanism (not shown).

The tape cartridge C has a cartridge casing 24 in which are accommodated at an upper central position thereof and at a lower right position thereof the tape reel 29 reeling up the tape T with a uniform width and a ribbon reel 27 reeling up the ink ribbon R, respectively. The tape T and the ink ribbon R have the same width in size. At a left lower position of the tape reel 29, there is made a through hole 28 to be fitted with the head cover 17 covering the head unit 16. Besides, at a position where the tape T and the ink ribbon R overlap each other, there is arranged a platen roller 25 which is driven to rotate by fitting the platen driving shaft 18. On the other hand, there is arranged a ribbon taking-up reel 26 near the ribbon reel 27. The ink ribbon R reeled out from the ribbon reel 27 is reeled up by the ribbon taking-up reel 26 in such a manner as to travel around the head cover 17.

When the tape cartridge C is mounted in the cartridge mounting section 14, the head cover 17, the positioning projection 23 and the reel driving shaft 19 are fitted with the through hole 28, the center hole of the tape reel 29, and the center hole of the ribbon taking-up reel 26, respectively. The printing head 15 comes into contact with the platen roller 25 sandwiching the tape T and the ink ribbon R to perform ink-characters printing. The tape T is printed with ink characters based on inputted character information and then fed into the printing-tape ejecting port 21.

Although not specifically shown in the figures, the tape T is composed of a substrate sheet whose rear face is provided with an adhesive layer, which is made of a polyethylene terephthalate (PET) film, and of a releasing paper affixed to the substrate sheet by the adhesive layer. The releasing paper is used to prevent dust etc. from adhering to the adhesive layer until the substrate sheet is used as a label, and is made of a quality paper whose front face is subjected to silicone treatment. In this state, the adhesive layer has much less adhesion to the releasing paper than to the substrate layer.

The tape T has a plurality of types varying in tape width, tape color, ink color of ink characters, tape material, etc. Therefore, there are provided a plurality of holes (not shown) for discriminating the types of the tape T on the rear face of the cartridge casing 24. In addition, in the cartridge mounting section 14, there are provided a plurality of tape discriminating sensors (micro switches) 141 (see FIG. 6) for detecting the types corresponding to the plurality of holes. In other words, the tape type can be determined by detecting the state of the tape discriminating sensors 141.

On the other hand, the rear casing 2*b* includes therein a braille embossing assembly where a main component unit is incorporated into an apparatus frame 65, and the top face thereof is opened in a cross shape such that the upper part of the braille embossing assembly is exposed. On the right and left sides of such a cross-shaped exposing section 32, there are formed an embossing-tape inserting section 33 into which the tape T is manually inserted by the user and an embossing-tape ejecting section 34 from which the tape T embossed in braille is ejected, respectively. In other words, the braille embossing section 30 has on the right side thereof the embossing-tape inserting section 33 with its top face open and on the left side thereof the embossing-tape ejecting section 34 with its top face open, thereby constituting a tape traveling path 70.

The braille embossing assembly has: the embossing unit 80 in which braille is embossed by three embossing pins 41 (see FIG. 3B); the tape feeding mechanism 60 for feeding into the embossing-tape ejecting section 34 the tape T inserted into the embossing-tape inserting section 33; and the tape traveling path 70 ranging from embossing-tape inserting section 33 to the embossing-tape ejecting section 34. In the braille embossing assembly, the three embossing pins 41 are selectively driven by the embossing unit 80 to form braille B on the tape T being fed along the tape traveling path 70 driven by the tape feeding mechanism 60.

Figure 5:
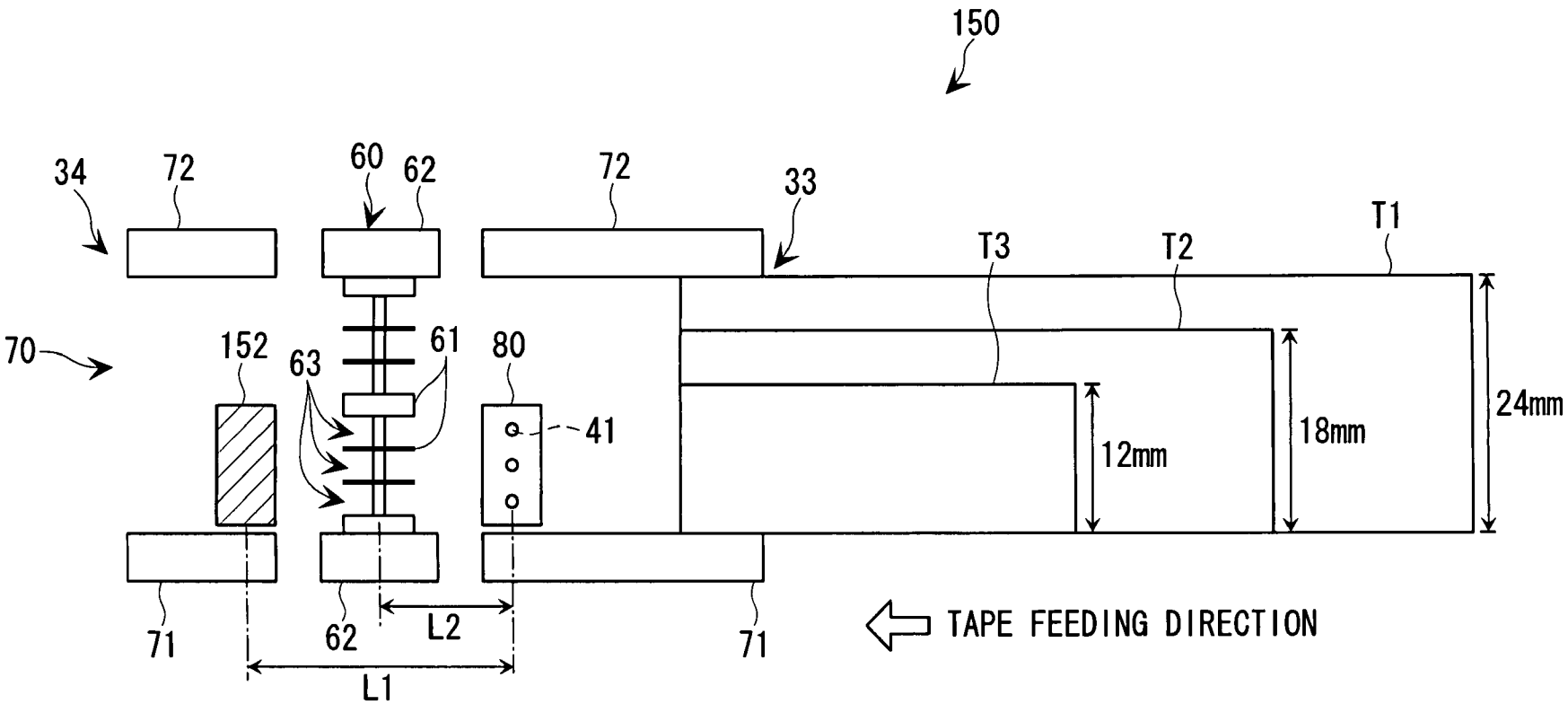
FIG. 5 is an illustration for explaining the delivery of a tape in a braille embossing section.
Figure 6:
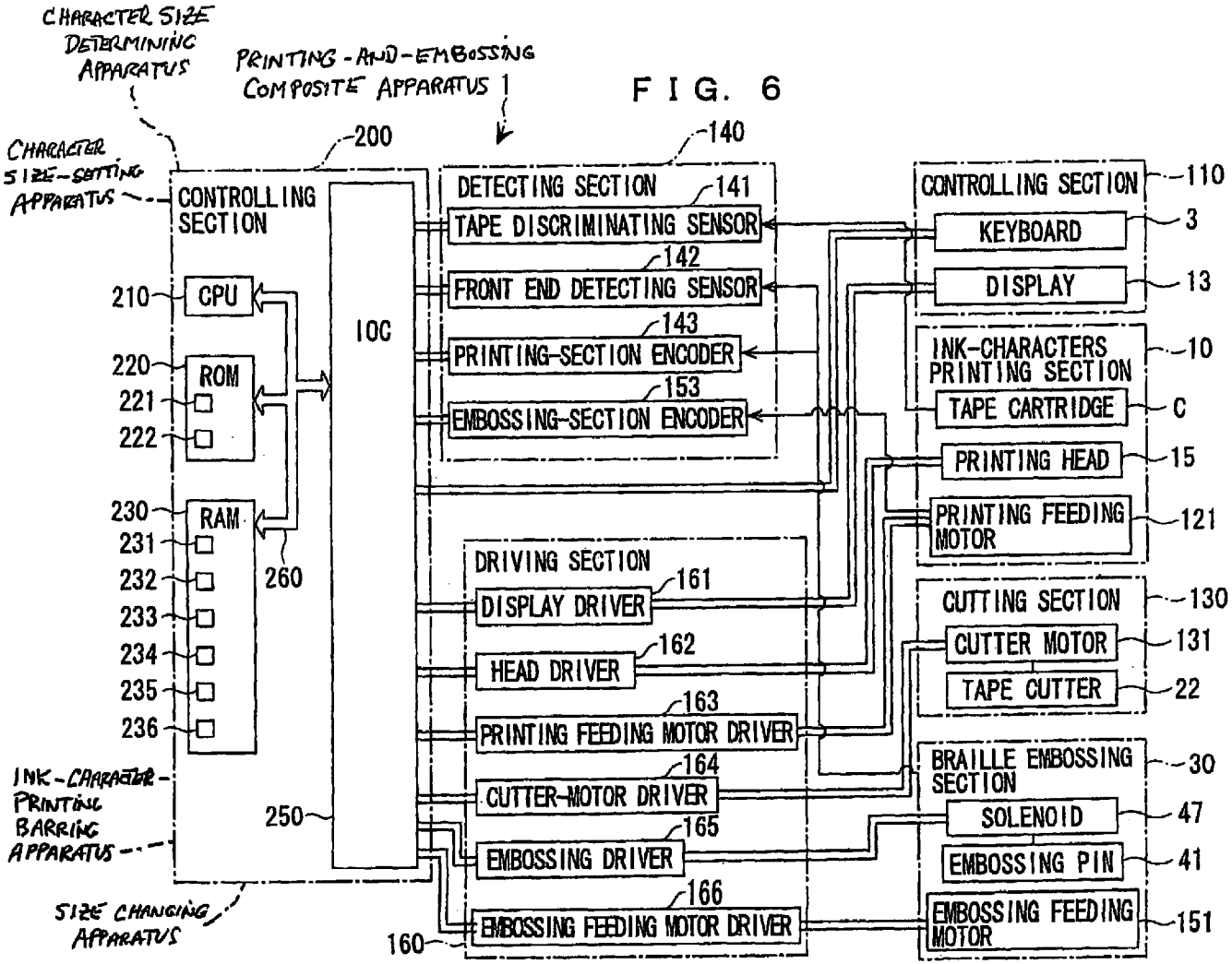
FIG. 6 is a control block diagram of the printing-and-embossing composite apparatus.
Figure 7:
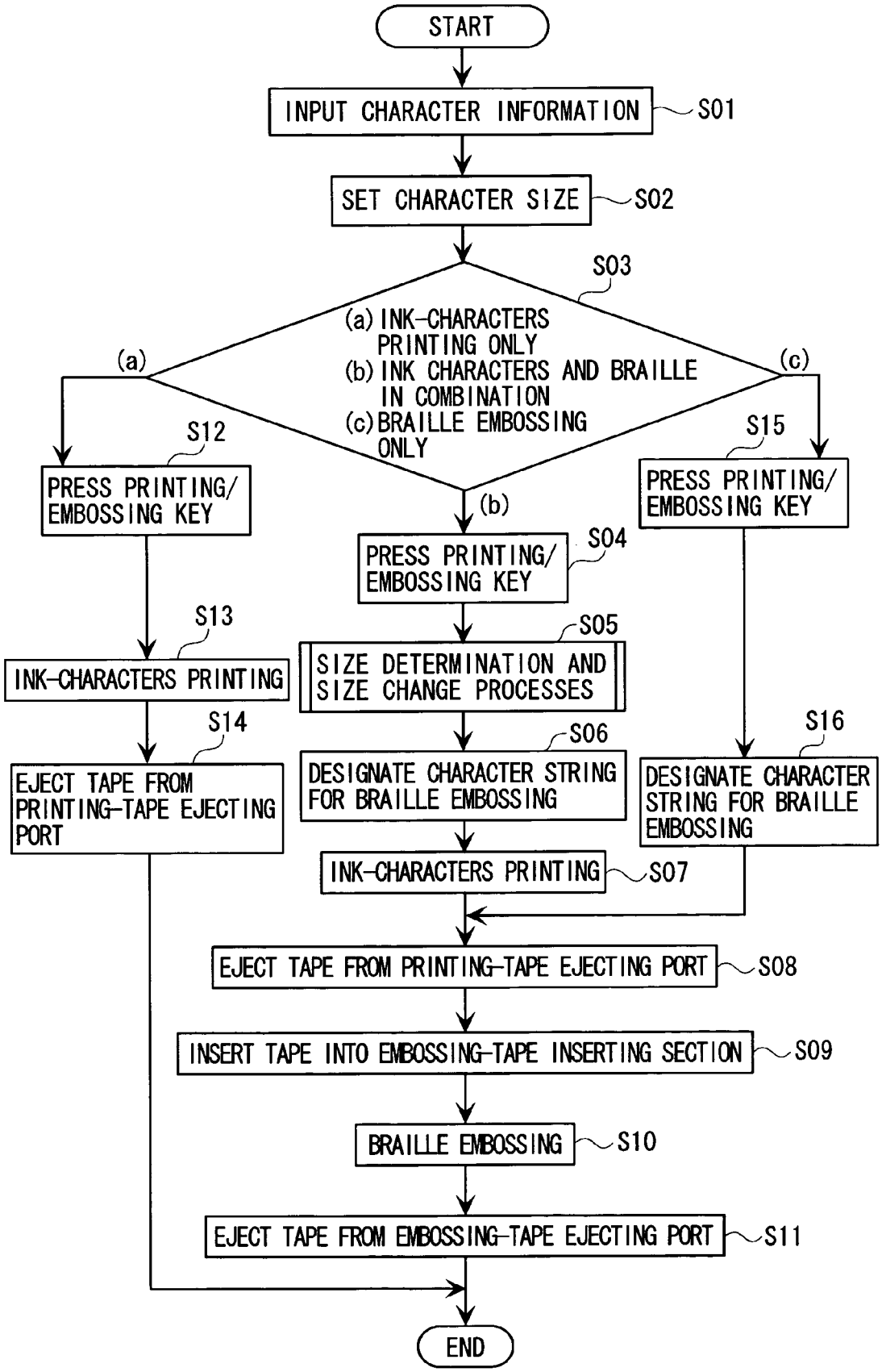
FIG. 7 is a flow chart showing an entire process of the printing-and-embossing composite apparatus.

The tape feeding mechanism 60 is composed of: feeding rollers 61 which can move back and forth; supporting members 62 for rotatably supporting the feeding rollers 61 on an apparatus frame 65; and an embossing feeding motor 151 for causing the feeding rollers 61 to rotate through the torque transmission mechanism (not shown) (see FIG. 6). The feeding rollers 61 are composed of grip rollers having driving rollers (not shown) and driven rollers 61*a* (see FIG. 1). Between the driven rollers 61*a* are formed annular grooves 63 (see FIG. 5) free from interference from (arranged in such a manner as to prohibit interfering with) vertical three positions (the positions corresponding to vertically-arranged three embossing points 201 (see FIG. 4A)) in the width direction of the tape traveling path 70, so as to prevent the formed braille B from being crushed.

Figure 3A:
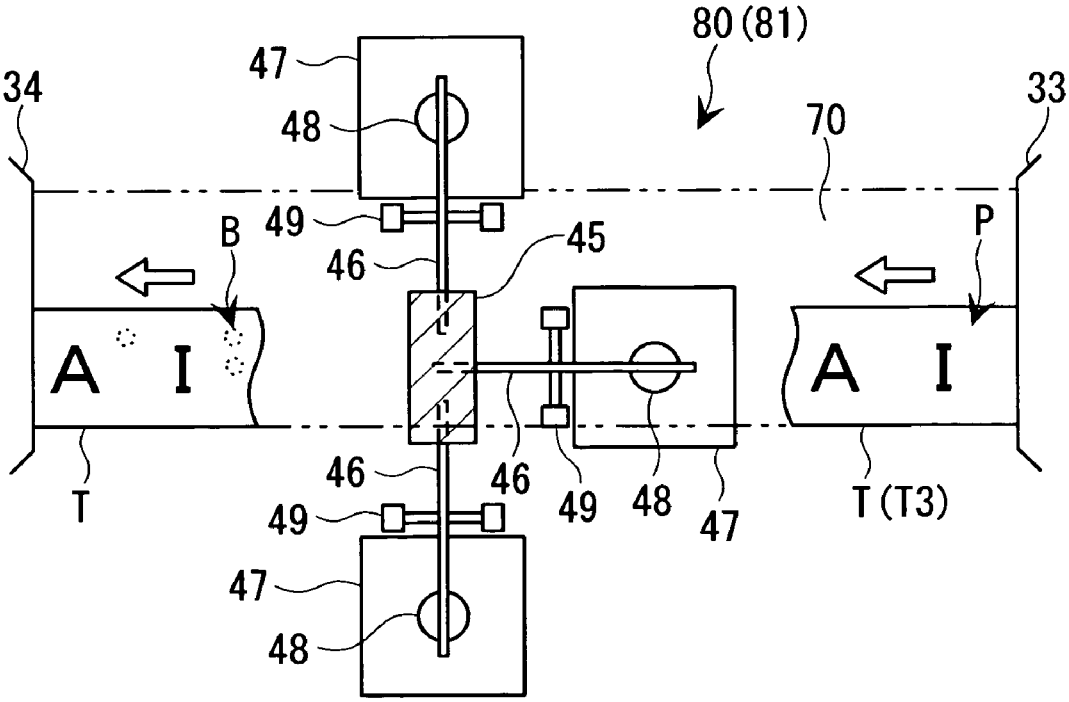
FIGS. 3A and 3B are a plan view and a cross section of an embossing unit.
Figure 3B:
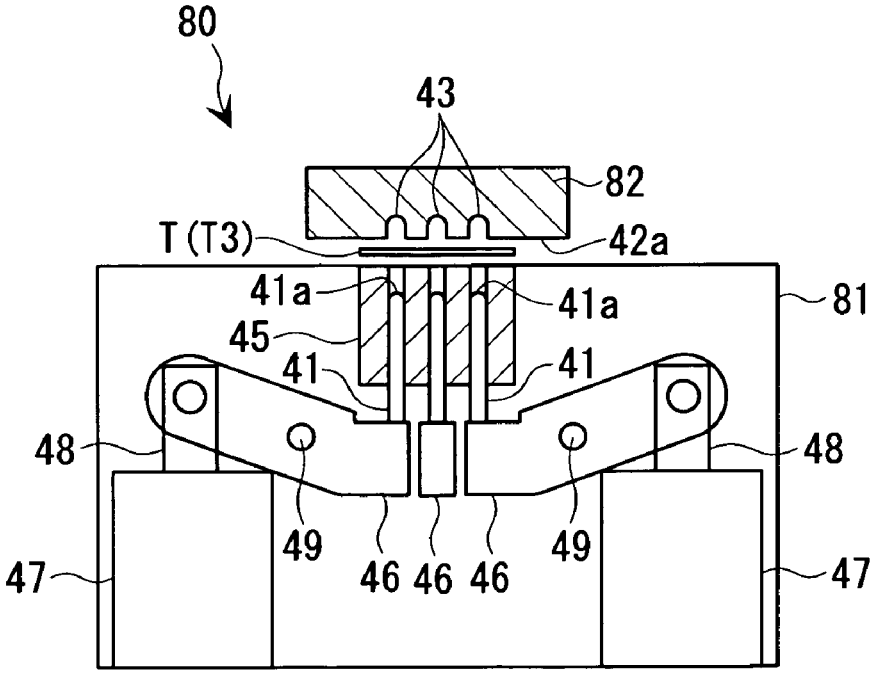

As shown in FIGS. 3A and 3B, the embossing unit 80 is composed of an embossing member 81, three solenoids 47, and an embossing receiving member 82. The embossing member (embossing head) is arranged on the rear face of the tape T and includes the three embossing pins 41 fitted into a guide block 45. The three solenoids causes each of the embossing pins 41 to operate for embossing through embossing arms 46. The embossing receiving member is arranged at respective locations above and below the tape T in such a manner as to be opposed to the embossing member 81 (embossing pins 41) (see FIG. 3B). The embossing receiving member 81 has formed therein three receiving grooves corresponding to the three embossing pins 41. With this configuration, the solenoids are caused to operate for braille embossing toward the receiving grooves, to thereby form an embossing convex portion on the tape T. The embossing unit 80 is fixed in position at the near end in the width direction of the tape traveling path 70 (see FIG. 3A). Thus, when braille is embossed on a tape T1 with the maximum width of 24 mm, the lower half in the width direction of the tape T1 is to be embossed (see. FIG. 5).

Figure 4A:
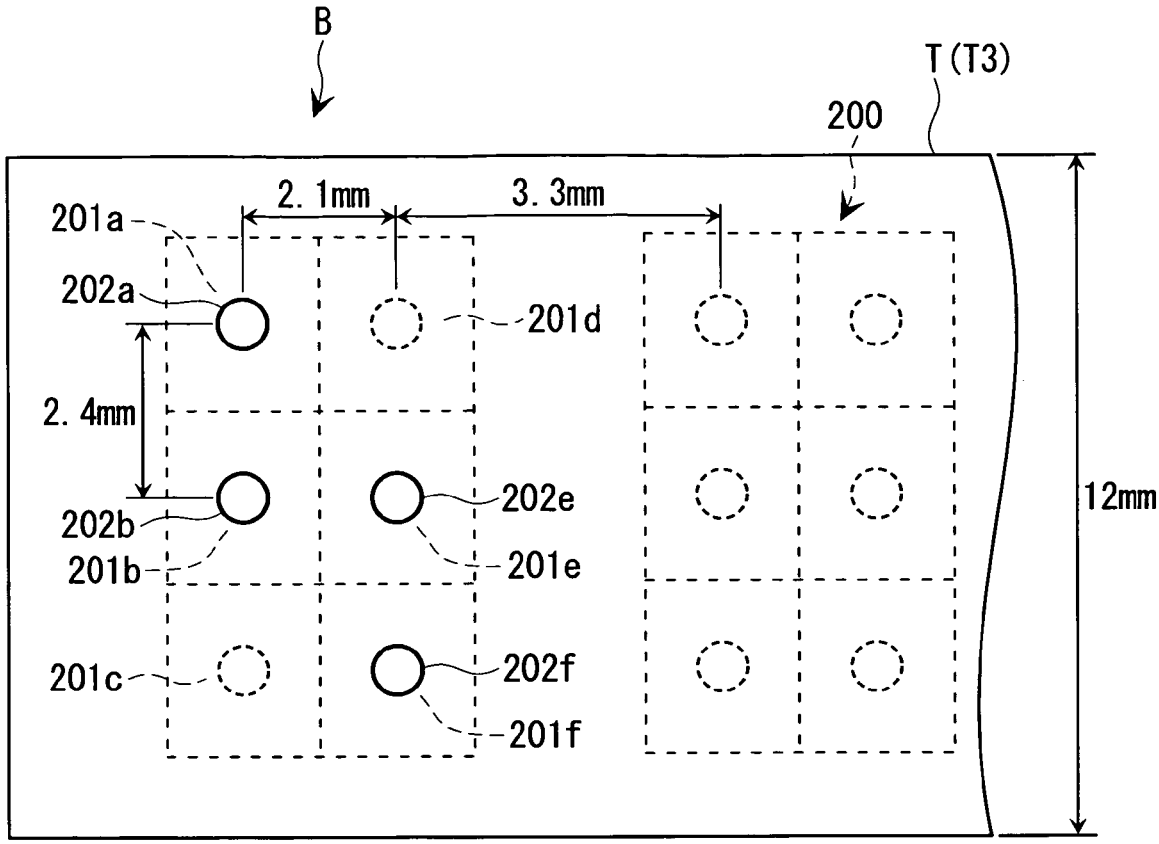
FIGS. 4A and 4B are illustrations of a 6-point (3×2) embossing of braille and a cross section of an embossing convex portion.

A description of braille B (six-point braille B) to be formed on the tape T (T3 with a width of 12 mm) will now be made with reference to FIGS. 4A and 4B. FIG. 4A shows the braille B (braille data) indicative of character information "SHI" (representing herein a hiragana character). As shown in the figure, the six-point braille B forms one square 200 constituted of six points (embossing dots) of three dots, which in turn are constituted of three dots in length×two dots in width. The one square 200 represents a character, a voice sound symbol, etc. Besides the six-point braille indicative of kana-characters, numerals, etc., the braille B has a type of an eight-point braille (which forms a bit pattern constituted of four dots in length×two dots in width) indicative of Chinese characters. A description will be made about the six-point braille B in the printing-and-embossing composite apparatus of the present embodiment, but the eight-point braille could be applied thereto as a matter of course.

In the six-point braille B, the one square 200 is divided into six embossing points 201*a* to 201*f* under the arrangement of three dots in length×two dots in width. FIG. 4A shows a state of the character "SHI" where four embossing points 201*a*, 201*b*, 201*e*, and 201*f* are selectively embossed from among the six embossing points 201*a* to 201*f*; and four embossing convex portions 202*a*, 202*b*, 202*e*, and 202*f* are formed on the tape T. Further, six embossing convex portions 202 are approx. 2.4 mm in vertical pitch and approx. 2.1 mm in horizontal pitch. A pitch from a dot in one square to a dot in another square is approx. 3.3 mm.

Figure 4B:
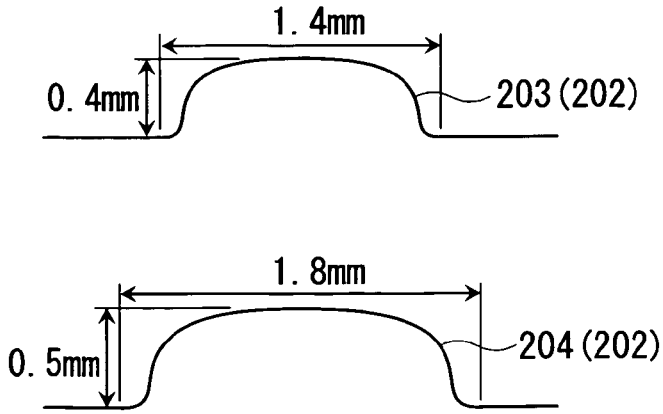

FIG. 4B shows cross sections of the embossing convex portions 202. As shown in the figure, the embossing convex portions 202 are cylindrical with its corner rounded. Note that the embossing convex portions 202 are preferably in such shape (as it feels good to the touch). However, other shapes, such as a hemisphere shape, a cone shape, and a quadrangular pyramid shape may also be accepted.

Further, the braille embossing section 30 of the present embodiment may adopt two other types of mutually replaceable units as the embossing unit 80: one forms small embossing convex portions 203 and the other large embossing convex portions 204. The small embossing convex portions 203 are cylindrical with a diameter of approx. 1.4 mm and a height of approx. 0.4 mm. The large embossing convex portions 204 are cylindrical with a diameter of approx. 1.8 mm and a height of approx. 0.5 mm. These two types of embossing convex portions 203 and 204 may be used according to intended purpose. For example, the small embossing convex portions 203 are intended for those familiar with reading the braille B (congenital blind people), and the large embossing convex portions 204 for beginners (noncongenital blind people).

Next, a description of the feeding of the tape T in the braille embossing section 30 will be made with reference to FIG. 5. As described above, the braille embossing section 30 is composed not only of: the embossing unit 80 for forming the embossing convex portions 202 on the tape T with the embossing pins 41; the tape traveling path 70 along which the tape T is fed; the tape feeding mechanism 60 for feeding the tape T along the tape traveling path 70; but also of guide members 71 and 72 for guiding the feeding of the tape T; and a transmission front end detecting sensor 142 for detecting the front end of the tape T.

In the embossing-tape inserting section 33, the three types of tapes in a decreasing order of the tape width, i.e., T1 (with a width of 24 mm), T2 (with a width of 18 mm), and T3 (with a width of 12 mm) can be inserted. The tape T1 with the maximum tape width is guided by the upper and lower guide members 71 and 72, whereas the tapes T2 and T3, each with a smaller tape width as compared with the tape T1, are guided only by the lower guide members 71. For example, when the tape T3 with the minimum tape width is used, the user manually inserts it along the front lower guide member 71 until the front end thereof reaches (namely, it is positioned in such a manner as to be inserted into) the tape feeding mechanism 60

(feeding rollers 61). Upon insertion of the tape, the tape feeding mechanism 60 causes the feed of the tape T3 to start.

At this time, when a front margin from the front end of the tape to an embossing start position is set shorter than L1, the length extending between the embossing unit 80 (embossing pins 41) and the front end detecting sensor 142 (note, however, that the front margin should be set longer than L2, the length extending between the embossing unit 80 and the feeding rollers 61 in view of the positional relationship involved), the feeding rollers 61 are caused to backlash to feed back the tape T. When the tape T is fed back to a given position (i.e., tape-head aligned position) by a counter rotation, embossing and feeding thereof to the positive direction begin. When the embossing is completed, the tape feeding mechanism 60 causes the tape to be fed at a given distance. Then, the tape T is ejected from the embossing-tape ejecting section 34.

Next, a description of the control structure of the printing-and-embossing composite apparatus 1 will be made with reference to FIG. 6. The printing-and-embossing composite apparatus 1 is composed of: an operating section 110 serving as a user interface; an ink-characters printing section 10 for ink-characters printing; a braille embossing section 30 for braille embossing; a cutting section 130 for cutting the tape T into a given length; a detecting section 140 for various detections; a driving section 160 for driving each of the sections, and a controlling section 200 connected to each of the sections, for controlling the printing-and-embossing composite apparatus 1 as a whole.

The operating section 110 has the keyboard 3 and the display 13, which allows the user to input character information and display various information. The ink-characters printing section 10 has the tape cartridge C, the printing head 15, and the printing feeding motor 121, and prints on the tape T ink-characters data based on character information while feeding the tape T and the ink ribbon R. The cutting section 130 has the tape cutter 22 and the cutter motor 131 for driving the tape cutter, and cuts the tape T into a given length.

The detecting section 140 has: the tape discriminating sensors 141 for discriminating the type of the tape T (tape cartridge C); the front end detecting sensor 142 for detecting the front end of the tape T in the braille embossing section 30; a printing-section encoder 143 for detecting the rotating speed of the printing feeding motor 121; and an embossing-section encoder 153 for detecting the rotating speed of the embossing feeding motor 151. With such sensors, the detecting section performs various detections.

The driving section 160 has a display driver 161, a head driver 162, a printing feeding motor driver 163, a cutter motor driver 164, an embossing driver 165 for causing the solenoids 47 and embossing pins 41 of the braille embossing section 30 to operate, and an embossing feeding motor driver 166 for causing the embossing feeding motor 151 of the braille embossing section 30 to operate. With such drivers, the driving section drives each of the sections.

The controlling section 200 has a CPU 210, a ROM 220, a RAM 230, and an input/output controller 250 (hereinafter referred to as IOC), all of which are connected to one another through an internal bus 260. The ROM 220 has a control program block 221 and a control data block 222. The control program block stores therein control programs for controlling various processes including ink-characters printing or braille embossing with the CPU 210. The control data block stores therein control data for controlling embossing of braille data, in addition to character font data for ink-characters printing, after-mentioned character size data, and braille font data for braille embossing. Note that the character font data may be stored in a CG-ROM (character generation ROM), rather than in the ROM 220.

The RAM 230 has: various work area blocks 231 to be used as a flag etc.; an ink-characters printing data block 232 for storing generated ink-characters printing data; a braille embossing data block 233 for storing generated braille embossing data; and a display data block 234 for storing display data to be displayed on the display 13. In other words, the RAM is used as a work area for control processes. Further, the RAM 230 is always battery-protected for holding stored data in case of power-off.

The IOC 250 has incorporated therein a logic circuit for complementing functions of the CPU 210 and handling interface signals with various peripheral circuits through a gate array and a custom LSI. Thereby, the IOC 250 receives into the internal bus 260 input data or control data through the keyboard 3 either with or without processing the same. In addition, the IOC outputs to the driving section 160 data or control signals outputted to the internal bus 260 from the CPU 210 either with or without processing the same while interlocking the CPU 210.

With the above configuration, the CPU 210 inputs various signals/data from each section of the printing-and-embossing composite apparatus 1 through the IOC 250 in accordance with the control programs of the ROM 220. Further, the CPU processes various data of the RAM 230 based on the inputted various signals/data, and outputs the various signals/data to each section of the ink-characters printing section 10 through the IOC 250, thereby controlling the processes of ink-characters printing and/or braille embossing.

Further, the braille embossing section 30 is provided with the solenoids 47, the embossing pins 41, and the embossing feeding motor 151, and embosses on the tape T, which is being fed, braille data based on the generated braille embossing data.

For example, when the user inputs character information through the keyboard 3, the CPU 210 generates ink-characters printing data based on the inputted character information and temporarily stores the same in the ink-characters printing data block 232. Besides, upon receiving directions for printing/embossing and the designated character string for braille embossing through the keyboard 3, the CPU generates braille embossing data and temporarily stores the same in the braille embossing data block 233. Also, the CPU causes the printing feeding motor 121 to start and the printing head 7 to operate in response to a detection result by the printing-section encoder 143, thereby performing ink-characters printing based on the ink-characters data of the ink-characters printing data block 232. Thereafter, the CPU causes the tape to be fed at a given distance based on the ink-characters printing data, thereby cutting off a tape rear end with the tape cutter 22 and ejecting the tape T printed with ink characters from the printing-tape ejecting port 21.

Subsequently, when the user manually inserts the tape T from the embossing-tape inserting section 33, the CPU 210 causes the embossing unit 80 and the tape feeding mechanism 60 to operate, thereby performing braille embossing based on the generated braille embossing data with the braille embossing section 30. When the embossing is completed, the CPU causes the embossing feeding motor 151 to operate to feed the tape T, thereby ejecting the same embossed in braille from the embossing-tape ejecting section 34.

Meanwhile, the printing-and-embossing composite apparatus 1 has printing modes including a mode for performing only ink-characters printing on the tape T (hereinafter referred to as "INK-CHARACTERS PRINTING ONLY"), a mode for performing both ink-characters printing and braille embossing (hereinafter referred to as "INK CHARACTERS AND BRAILLE IN COMBINATION"), and a mode for performing only braille embossing (hereinafter referred to as "BRAILLE EMBOSSING ONLY"), one of which the user can select by pressing the mode selecting key. In other words, when the user forms braille labels, he/she sets a printing mode through the mode selecting key and then presses the printing/embossing key to start ink-characters printing and braille embossing. Note that, in the case of the INK CHARACTERS AND BRAILLE IN COMBINATION, ink-characters printing and braille embossing are performed on the same printing region of a printing face.

Further, according to the printing-and-embossing composite apparatus 1 of the present invention, for performing ink-characters printing and braille embossing, an ink-characters printing region and a braille embossing region can separately be defined in the same printing face to prevent ink characters and braille from overlapping each other. For the sake of convenience, however, the following description will be made on the assumption that a superposing process is employed, with ink-characters printing and braille embossing overlapping each other, when the process mode of the INK CHARACTERS AND BRAILLE IN COMBINATION is selected.

Next, a description will be made about a flow of ink-characters printing and braille embossing in the printing-and-embossing composite apparatus 1 of the present invention. First, when the user inputs character information through the keyboard 3 (S01), the character information inputted by the user or the printing-and-embossing composite apparatus 1 is set to have a specific size (S02). Then, one of the process modes (INK-CHARACTERS PRINTING ONLY, INK CHARACTERS AND BRAILLE IN COMBINATION, BRAILLE EMBOSSING ONLY) is selected by the user (S03), to thereby proceed to the next process.

In the case of the "INK CHARACTERS AND BRAILLE IN COMBINATION" in which ink-characters printing and braille embossing are performed in a superposed state (S03: (b)), when the printing/embossing key is pressed by the user (S04), the printing-and-embossing composite apparatus 1 determines whether or not the size of the inputted character information is set equal to or less than a given size, and changes the same as required (S05). The printing-and-embossing composite apparatus 1 then acquires the designated character string for braille embossing (S06) to generate braille embossing data, and performs ink-characters printing based on the character information (S07). Detailed description of the above process will be made hereinafter.

Subsequently, the printing-and-embossing composite apparatus 1 causes the tape T printed with ink characters to be cut and ejected from the printing-tape ejecting port 21 (S08). When the user inserts the ejected tape T from the embossing-tape inserting section 33 of the braille embossing section 30 (S09), the braille embossing section 30 performs braille embossing on an embossing region S based on the generated braille embossing data (S10). The tape T embossed in braille is ejected from the embossing-tape ejecting section 34, and the process is completed (S11).

In the case of the "INK-CHARACTERS PRINTING ONLY" (S03: (a)), when the printing/embossing key is pressed by the user (S12), the printing-and-embossing composite apparatus 1 performs ink-characters printing on the tape T based on the inputted character information (S13), and causes the tape T to be cut and ejected from the printing-tape ejecting port 21 (S14). On the other hand, in the case of the "BRAILLE EMBOSSING ONLY" (S03: (c)), when the printing/embossing key is pressed by the user (S15), the printing-and-embossing composite apparatus 1 acquires the designated character string for braille embossing (S16), and then generates braille embossing data. In addition, the printing-and-embossing composite apparatus 1 causes the tape T to be cut into a given length based on the generated braille embossing data and ejected from the printing-tape ejecting port 21 (S08). The tape T is then inserted from the embossing-tape inserting section 33 of the braille embossing section 30 by the user (S09), causing the braille embossing section 30 to perform braille embossing based on the generated braille embossing data (S10) and the tape T embossed in braille to be ejected from the embossing-tape ejecting section 34, and the process is completed (S11).

Note that, in the case of the "INK CHARACTERS AND BRAILLE IN COMBINATION" or the "BRAILLE EMBOSSING ONLY," the display 13 may give the user a message urging him/her to eject the tape T from the printing-tape ejecting port 21 and then insert the same into the embossing-tape inserting section 33. An indicator or an LED may substitute for such a message display.

Meanwhile, the printing-and-embossing composite apparatus 1 has character size data for setting character sizes corresponding to the number of lines inputted based on tape widths. Hereinafter, a description will be made about a case of the tape T with a width of 12 mm.

Input sizes as shown in FIGS. 8, 9A and 9B represent character-size patterns set for respective lines on the tape T with a width of 12 mm in which the numbers of inputted lines are two, three, or four. More specifically, "M+M" refers to a state in which a character string in the first line is of size M, and a character string in the second line is of size M. Note that a size pattern is selected by the user. Character sizes set for the tape T with a width of 12 mm are of three types of a character P, a character S, and a character M, as shown in FIGS. 8, 9A and 9B. The size of a character P is substantially the same as that of the plane face of an embossing convex portion for braille embossing. Accordingly, in the case of the "INK CHARACTERS AND BRAILLE IN COMBINATION," ink-characters printing with a character P is barred in view of the size (ink-characters-printing barring means).

Figure 10A:
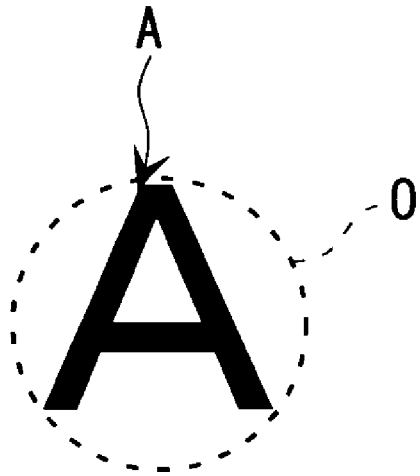
FIGS. 10A to 10C are illustrations for supplementally explaining a size substantially the same as that of a plane face of an embossing convex portion in braille embossing.
Figure 10B:
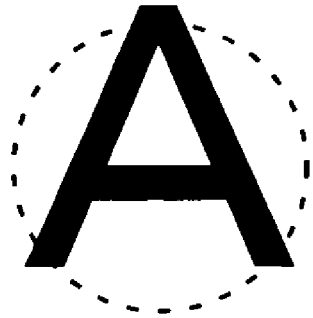
Figure 10C:
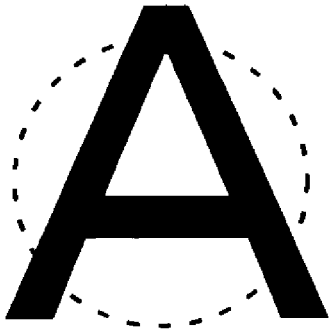

A detailed description will now be made about "the size substantially the same as that of the plane face of an embossing convex portion for braille embossing," which is a character size for which ink-characters printing is barred, with reference to FIGS. 10A, 10B, and 10C.

A size in which an ink character A fits into an embossing convex portion O (FIG. 10A) is, for example, recognized as the size substantially the same as that of the plane face of the embossing convex portion O as a matter of course. A size in which the ink character A slightly protrudes from the embossing convex portion O (FIG. 10B) is also recognized as the size substantially the same as that of the plane face of the embossing convex portion O since the printed ink character A can be unrecognized or misidentified although it is larger in size than the embossing convex portion O. On the other hand, a size in which the ink character A protrudes without doubt from the embossing convex portion O (FIG. 10C) is not recognized as the size substantially the same as that of the plane face of the embossing convex portion O since the printed ink character A is recognizable. Note that, in the printing-and-embossing composite apparatus 1 of the present embodiment, it is assumed that only the size of a character P is the size substantially the same as that of the plane face of the embossing convex portion O.

For a tape with a width of 12 mm where the number of inputted lines is two, when a character of inputted character information has the size of a character P, under which No. 3 and No. 8 in FIG. 8 fall, the size of character information consisting of a character P in the line is changed to that of a character S (see sizes after change in FIG. 8). Further, for a tape with a width of 12 mm where the number of inputted lines is three, when the character of inputted character information has the size of a character P, under which No. 2 to No. 16 in FIG. 9A fall, the size of character information consisting of a character P in the line is changed to that of a character S. In addition, when the inputted character information resulting from the change in size fails to fit into the printing region of the tape T (the character of inputted character information has the size of a character M), i.e., insufficient tape width, the size of a character M in the other lines is changed to that of a character S (see sizes after change in FIG. 9A). Note that, in the size change process, when it is not necessary to change character sizes of all the lines other than the one for which the character size has been set equal to or less than the size of a character P, the user may select a line whose size is to be changed.

Further, for a tape with a width of 12 mm where the number of inputted lines is four, the character size to be set is only the size of a character P (see input sizes in FIG. 9B). In this case, when the character sizes for all the inputted lines are changed from the size of a character P to that of a character S, an insufficient tape width will result, which makes it impossible to perform printing. In an attempt to address the solution, any specific one of the inputted lines may be deleted to enable the character size to be changed from the size of a character P to that of a character S (see sizes after change in FIG. 9B).

A description will now be made about the process flow of size determination (determining means) and size change (size changing means).

Figure 11:
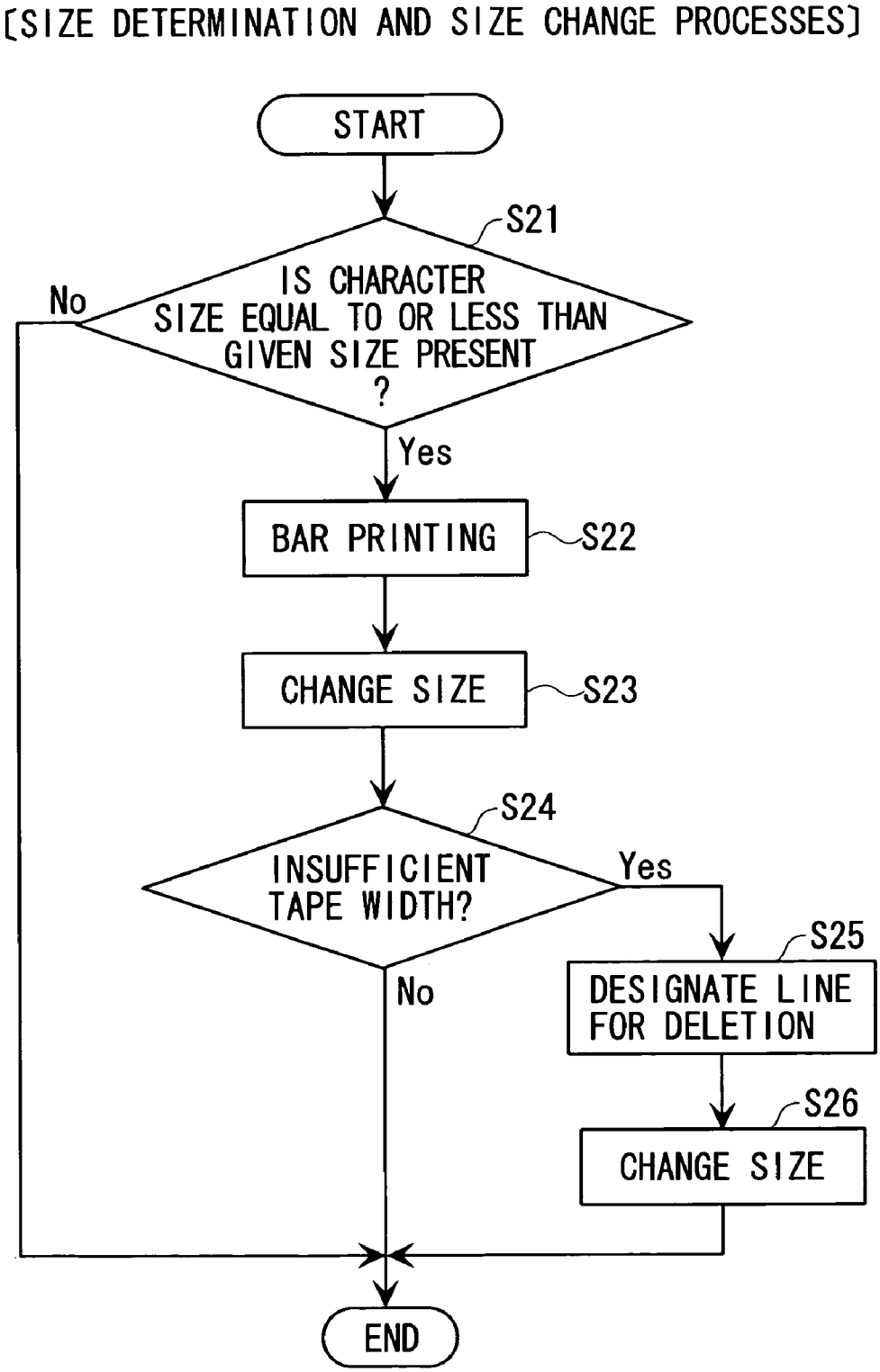
FIG. 11 is a flow chart showing size determination and size change processes in the printing-and-embossing composite apparatus.

FIG. 11 is a flow chart showing size determination and size change processes. In a case where the printing mode has been set to the "INK CHARACTERS AND BRAILLE IN COMBINATION," when the printing/embossing key is pressed by the user, the printing-and-embossing composite apparatus 1 starts size determination and size change processes, and determines whether or not a character size of inputted character information is equal to or less than a given size (the size of a character P in this embodiment) (S21). When it is determined that the character size is equal to or less than the given size (S21: Yes), the printing-and-embossing composite apparatus 1 suspends printing (S22), and performs the process to change the character size (S23). When an insufficient tape width results during the process for changing the character size (S24: Yes), the printing-and-embossing composite apparatus 1 displays a screen for designating a line for deletion (S25), and performs the deleting process. Accordingly, the character size is changed, and the process is completed (S26).

Next, a description will be made about a process flow ranging from the time character information is inputted to the time ink-characters printing and braille embossing are performed, with reference to the screen transition of FIGS. 12A and 13.

FIG. 12A shows a case where input character information is inputted over three lines. The input character information comprises "OOITOSEN" (representing kanji character for "Ooito-Line" which is the name of a Japanese local railway line) of the first line, "ROKUBANSEN" (representing kanji character for "Track No. Six") of the second line, and "ORIGUCHI" (representing kanji character for "Exit") of the third line, all of which are to be inputted. The character sizes of the first to third lines are set to the size of a character S, the size of a character P, and the size of a character M (according to No. 14 in FIG. 9A), respectively. The user then presses the mode selecting key to display the printing mode selecting screen (T10 in FIG. 12A). As described above, the user is allowed to select a printing mode (INK CHARACTERS ONLY, INK CHARACTERS AND BRAILLE IN COMBINATION, BRAILLE EMBOSSING ONLY) while viewing the screen.

When the user selects the "INK CHARACTERS AND BRAILLE IN COMBINATION" (shown as "INK CHARACTERS/BRAILLE" on the screen T10) and presses the printing/embossing key, an error message screen (T11 in FIG. 12A) appears indicating that it is impossible to print. The user is allowed to keep on the process and proceed to the size change process by pressing the printing/embossing key or the selecting key. Further, when the input character information is to be changed, the user presses another key to return to an edit screen therefor (not shown) to resume editing.

On the error message screen (T11 in FIG. 12A), when the user presses the printing/embossing key or the selecting key to proceed to the next process, the printing-and-embossing composite apparatus 1 performs the above-described size change process (see FIG. 9A). On a screen where a line of character string for braille embossing is designated (T12 in FIG. 12A), the user then designates the line number for braille embossing by using the numeric key ("OOITOSEN" of the first line is designated in the figure). Upon designation of the line number for braille embossing, the printing-and-embossing composite apparatus 1 starts printing in ink the inputted character information on the tape T and cuts it off with the tape cutter 22. The tape T is then ejected from the printing-tape ejecting port 21.

When the user inserts the tape T into the embossing-tape inserting section 33 of the printing-and-embossing composite apparatus 1, the braille embossing section 30 performs braille embossing on the already-printed tape T. The tape T embossed in braille is then ejected from the embossing-tape ejecting section 34. The braille label as shown in FIG. 12B shows a label subjected to the above-described flow of ink-characters printing and braille embossing. The braille label as shown in FIG. 12C shows a label formed of ink-characters printing and braille embossing in character sizes set at the original inputting and without being subjected to size determination and size change processes of the present invention. For braille embossing, translation for braille is performed based on character information of the designated line number to generate braille embossing data. (Note: In FIGS. 12B–12C and 13B–13C, alphabetical representation "OOITOSEN" is based on transliteration from kanji characters to avoid the use of characters other than alphabets; the braille embossing used therein corresponds to the pronunciation of kanji, not to alphabets. The same applies to FIGS. 13B–13C.) FIG. 13A shows a case where input character information is inputted over four lines. The input character information comprises "OOITOSEN" (Ooito-Line) of the first line, "ROKUBANSEN" (Track No. Six) of the second line, "ORIGUCHI" (Exit) of the third line, and "KAIDANTESURI" ("Stair Rail") of the fourth line, all of which are to be inputted. When the user presses the mode selecting key, the printing mode selecting screen (T20 in FIG. 13A) appears.

In a case where input character information is inputted over four lines, when the user selects the "INK CHARACTERS AND BRAILLE IN COMBINATION" (shown as "INK CHARACTERS/BRAILLE" on the screen T20) and presses the printing/embossing key, the character sizes for all the lines are set to the size of a character P. Accordingly, an error message screen (T21 in FIG. 13A) appears indicating that it is impossible to print. On the error message screen (T21 in FIG.

13A), the user designates the line number of the line for deletion out of the inputted lines by pressing the numerical key. Further, the user presses another key to return to an edit screen therefor (not shown) to resume editing. Note that the user may designate line deletion priority in advance so that lines are automatically deleted by the printing-and-embossing composite apparatus 1, in the order as prescribed, instead of designating one line after another for deletion.

After designating the line number of the line for deletion ("KAIDANTESURI" of the fourth line in the figure) on the error message screen (T21 in FIG. 13A), the user designates the line number for braille embossing by using the numerical key ("OOITOSEN" of the first line is designated in the figure). Thereafter, the printing-and-embossing composite apparatus 1 starts printing in ink the inputted character information on the tape T and cuts it off with the tape cutter 22. The tape T is then ejected from the printing-tape ejecting port 21.

When the user inserts the tape T into the embossing-tape inserting section 33 of the printing-and-embossing composite apparatus 1, the braille embossing section 30 performs braille embossing on the tape T. The tape T embossed in braille is then ejected from the embossing-tape ejecting section 34. The braille label as shown in FIG. 13B shows a label subjected the above-described flow of ink-characters printing and braille embossing. The braille label as shown in FIG. 13C shows a label formed of ink-characters printing and braille embossing in character sizes set at the original inputting and without being subjected to size determination and size change processes of the present invention.

As described above, when ink-characters printing and braille embossing are performed on the same printing region of the printing face of the tape T in a superposed state, ink-characters printing in the size of a character P substantially the same as that of the plane face of the embossing convex portion formed by braille embossing is barred and the size thereof is changed to avoid illegibility of the printed ink-characters. Note that the above-described size determination and size change processes may be performed immediately after a printing mode has been set to the "INK CHARACTERS AND BRAILLE IN COMBINATION." As a result, the process time for ink-characters printing can be further shortened.

Alternatively, the setting of the character size barring ink-characters printing may be made before inputting of character information. Hereinafter, a description will be made about a second embodiment where the setting of the character size barring ink-characters printing is made before inputting of character information.

Figure 14:
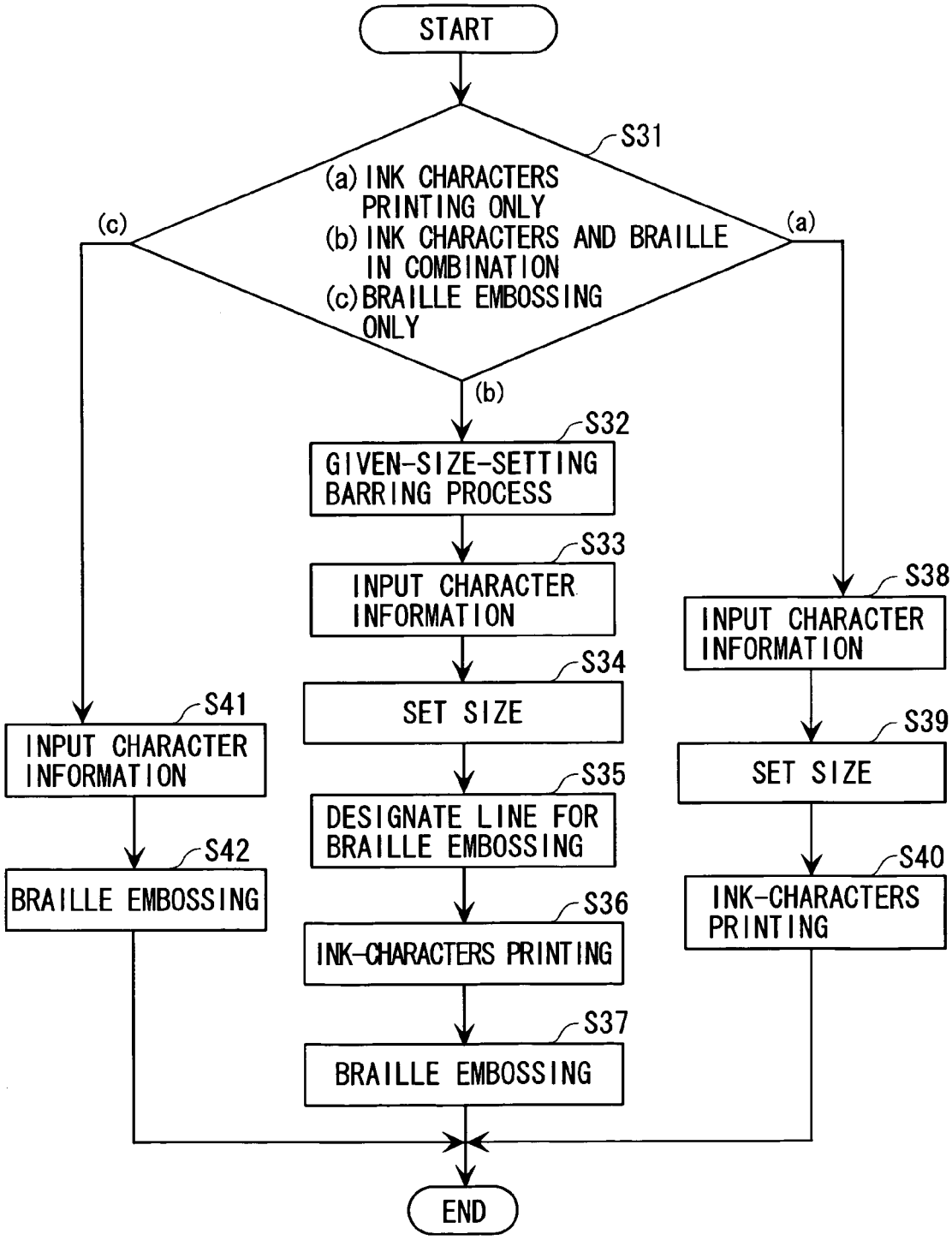
FIG. 14 is a flow chart showing an entire process in the printing-and-embossing composite apparatus according to a second embodiment of the present invention.

FIG. 14 is a flow chart showing the processes of ink-characters printing and braille embossing in the second embodiment.

The user first presses the mode selecting key to select a printing mode (INK CHARACTERS ONLY, INK CHARACTERS AND BRAILLE IN COMBINATION, BRAILLE ONLY) on the screen displayed (S31). When the "INK-CHARACTERS AND BRAILLE IN COMBINATION" is selected by the user (S31: (b)), the printing-and-embossing composite apparatus 1 performs a given-size-setting barring process in which the size substantially the same as that of the plane face of the embossing convex portion, i.e., the size of a character P is barred for size setting (S32).

Through the given-size-setting barring process, the size of a character P substantially the same as that of the plane face of the embossing convex portion is barred for size setting. After the given-size-setting barring process, the user inputs character information (S33). Then, the user or the printing-and-embossing composite apparatus 1 sets the size of the inputted character information (S34). When the user inputs character information over three lines, for example, he/she is allowed to select only a size pattern from which the size of the character information for all the inputted lines result in the size of a character S (see sizes after change in FIG. 9A). The printing-and-embossing composite apparatus 1 acquires the designated line for braille embossing (S35), and causes ink-characters printing section 10 to perform ink-characters printing (S36) and the braille embossing section 30 to perform braille embossing. The process is then completed (S37).

Further, when the "INK CHARACTERS ONLY" is selected from among the printing modes (S31: (a)), after character information is inputted (S38), the user or the printing-and-embossing composite apparatus 1 sets the size thereof (S39) and performs ink-characters printing (S40). On the other hand, when the "BRAILLE ONLY" is selected from among the printing modes (S31: (c)), after character information is inputted (S41), the printing-and-embossing composite apparatus 1 causes the tape T to be ejected from the printing-tape ejecting port 21, and the braille embossing section 30 to perform braille embossing (S42).

Thus, when ink-characters printing and braille embossing are performed in a superposed state in the configuration of the second embodiment, the setting of a character size barring printing is made in advance. Accordingly, it is made possible for the user to eliminate the labor of changing the character size or deleting the inputted character information with the printing-and-embossing composite apparatus 1. As a result, the process time for ink-characters printing can be shortened.

Note that this embodiment refers to a tape with a width of 12 mm where character information is inputted over two to four lines. Also as to a tape T with a width other than 12 mm where character information is inputted over one line, when the input character information has a size substantially the same as that of the plane face of the embossing convex portion, i.e., the size of a character P, the above-described size determination and size change processes may be performed as a matter of course. Further, in this embodiment, setting of the size substantially the same as that of the plane face of the embossing convex portion, i.e., the size of a character P, is barred. Alternatively, sizes other than that of a character P may be used as a barred size. Accordingly, when labels other than a braille label are formed, the present invention is applicable to a case where a specific size is barred for size setting.

In addition, the apparatus casing 2 of the printing-and-embossing composite apparatus 1 is integrally formed by the front casing 2*a* having therein the ink-characters printing section 10 and the rear casing 2*b* having therein the braille embossing section 30 (see FIG. 1). Alternatively, it is possible to have a configuration in which these casings serve as an independent apparatus, both of which can be connected to each other through an interface (connector). With this configuration, the apparatus equivalent to the rear casing 2*b* can be used, as an option, only by those who are required to perform braille embossing, and the apparatus equivalent to the rear casing 2*b* can be changed in shape. Accordingly, the apparatus (ink-characters printing apparatus) equivalent to the front casing 2*a* can be improved in versatility.

Further, the respective components (functions) of the printing-and-embossing composite apparatus 1 shown in the foregoing examples can be provided as programs. They can be stored in a storage medium (not shown). The storage medium may be in the form of a CD-ROM, a flash ROM, a memory card (a compact flash (registered trademark), a smart media, a memory stick, etc.), a compact disk, a magnetic optical disk, a digital versatile disk, a flexible disk, etc.

The structure and the process steps in the printing-and-embossing composite apparatus 1 may be modified as needed without departing from the spirit and scope of the present invention, without being bound by the examples as described above.

What is claimed is:

1. A printing-and-embossing composite apparatus comprising:

a printing-and-embossing processing means capable of performing on the same object a superposing process for ink-characters printing and braille embossing, based on inputted character information;

a size setting means for setting a character size for use in the ink-characters printing based on the inputted character information;

a determining means for determining whether or not the character size set by the size setting means is set equal to or less than a size of a braille embossing convex portion;

an ink-characters-printing barring means for barring the ink-characters printing caused by the printing-and-embossing processing means, in cases where the superposing process is performed, and the determining means determines that the character size is set equal to or less than the size of the braille embossing convex portion; and a size changing means for changing the set character size to one which exceeds the size of the braille embossing convex portion when the ink-characters printing is barred by the ink-characters-printing barring means.

2. The printing-and-embossing composite apparatus according to claim 1, wherein, in cases where the character information is inputted over a plurality of lines and the character size is set for each line to fit into a specific width range of the object, but the character information fails to fit into the width range as a result of a change in the character size, the size changing means changes the character sizes of the lines other than the one for which the character size has been set equal to or less than the size of the braille embossing convex portion, to a character size equal to or less than the original size thereof.

3. The printing-and-embossing composite apparatus according to claim 1, wherein, in cases where the character information is inputted over a plurality of lines and the character size is set for each line to fit into a specific width range of the object, but the character information fails to fit into the width range as a result of a change in the character size, the size changing means deletes the character string of the designated specific line.

* * * * *